US007267254B2

(12) United States Patent
Perez

(10) Patent No.: US 7,267,254 B2
(45) Date of Patent: Sep. 11, 2007

(54) MR. PLUMBER'S HOLDER BY CLASP

(76) Inventor: Miquel Angel Perez, 883 Clopper Rd. #A1, Gaithersburg, MD (US) 20878

( * ) Notice: Subject to any disclaimer, the term of this patent is extended or adjusted under 35 U.S.C. 154(b) by 511 days.

(21) Appl. No.: 10/692,203

(22) Filed: Oct. 23, 2003

(65) Prior Publication Data

US 2004/0089688 A1 May 13, 2004

Related U.S. Application Data

(60) Provisional application No. 60/424,610, filed on Nov. 7, 2002.

(51) Int. Cl.
*A45C 1/04* (2006.01)

(52) U.S. Cl. ..... 224/666; 224/242; 224/269; 224/270; 224/313

(58) Field of Classification Search ..... 224/666, 224/242, 269, 270, 409; 248/311.3, 316.7, 248/313, 311.2; 211/75, 74
See application file for complete search history.

(56) References Cited

U.S. PATENT DOCUMENTS 451,097 A * 4/1891 Wilkinson ..... 211/74
1,741,136 A * 12/1929 Naylor ..... 248/231.41
2,320,828 A * 6/1943 Murphy ..... 211/88.01
4,062,482 A * 12/1977 Szalony ..... 224/247
4,697,780 A * 10/1987 Wenkman et al. ..... 248/558
4,825,590 A * 5/1989 Cullinane ..... 47/67
5,501,176 A * 3/1996 Tully ..... 119/61.57
5,655,673 A * 8/1997 Weterrings et al. ..... 211/75
5,857,601 A * 1/1999 Greenwood ..... 224/409
D411,603 S * 6/1999 Duran ..... D21/796
5,992,624 A 11/1999 Hodson
6,412,741 B1 * 7/2002 Olivero ..... 248/313
6,443,342 B1 * 9/2002 Kahn ..... 224/268

* cited by examiner

*Primary Examiner*—Tri M. Mai
(74) *Attorney, Agent, or Firm*—Dodds and Associates; Susanne Somersalo; John Dodds

(57) ABSTRACT

A holder device designed for clasping containers of glue and primer used by plumbers for installing and repairing pipes. The main frame of the holder device is a unit member made of flexible material and further comprising a vertical arm and a horizontal member. The vertical arm has an upper end tongue and a free elongated portion at the lower end. The upper end tongue ends with a hook enabling the plumber to adjust the devise on a belt. The holder device also has through rectangular hole in the arm designed for hanging the devise on supporting structures. The elongated portion of the lower end of the arm facilitates this function while bringing more stability and increasing the useful life of the holder device. The horizontal member has a carrying part with clasps, designed for holding glue and primer containers by pressure grip. Use of the holder device facilitates the movement and decreases the oscillation and instability while carrying and hanging primer and glue containers.

2 Claims, 6 Drawing Sheets

MR. PLUMBER'S HOLDER BY CLASP

This application claims the priority date of the provisional patent application No. 60/424,610 Filed on Nov. 7, 2002.

BACKGROUND OF THE INVENTION

The present invention is related to the field of plumbing. More specifically the invention is related to a holder device allowing plumbers to clasp together the primer and the glue containers.

Plumbers currently use two basic products, primer and glue, to install and repair water and waste pipes. These products are always applied one after the other and the plumbers have to keep them both close at hand.

Fitting pipe unions may be complicated because there are many points to fit and some of them are locating far away from each other. Furthermore, the pipes are often located in inaccessible places or in places with a very limited space. A normal practice is to assemble the cans of primer and glue by means of adhesive tape in order to carry them together. This practice however, has the disadvantage of drops and spills especially in locations with limited space.

Therefore there is a long-felt need of a light and simple design allowing clasping the primer and glue together without adding the problem of spilling and dropping and simultaneously allowing the plumber a freedom to move.

U.S. Pat. No. 5,992,624 discloses a plumber's caddy with a holder for plumbing tools, fittings and supplies. The caddy comprises a shallow base tray fixed with two cylindrical holders and one arm. The arm is a unitary member, but comprising three different parts, providing rotation and tilting of the holder. According to an alternative embodiment the glue and primer cans are attached to the rotating and tilting arm with two clips. A third alternative embodiment comprises a shallow base tray for both the cans and one clip.

Even if this invention is an improvement to the prior art, the disadvantage of all three embodiments is that they are difficult to carry or manage. The caddy and the arm are relatively large and heavy. The caddy is designed for multifunctional purposes. The rotating and tilting arm makes the apparatus unstable due to the variety of positions that the plumber assumes while working and thereby increasing the risk of drops and spills.

Further more as being composed from several parts makes the manufacture and operation more complicated.

The present invention solves these problems by providing a simple holder, preferably made of one unit and out of flexible material.

The holder according to the present disclosure provides easy access to containers, freedom of movement, lesser oscillations, neither spills and drops during the user of primer and glue canes, nor involves in expensive manufacturing.

SUMMARY OF THE INVENTION

The device is a simple holder, preferably only one unit, made of flexible material. The main aspect to the present invention comprises a unitary vertical arm made of one piece, integrally formed with two perpendicular clasps, adjacent to each other and an approximately 180-degree angle. The two clasps are for holding and carrying the containers for primer and glue, used by the plumbers. In addition, the device includes an opening in the vertical arm in order to hang the device from a ladder or other supporting structures. The invention also has a shaped tongue at the upper end of the arm to attach the device on a belt while working.

Consequently, one object of the present invention is to provide a simple and light holder for a plumber to hold glue and primer cans.

Another object is to provide a small and simple holder with a minimum number of members whereby manufacturing the device will not be expensive.

A still another object is to provide a small holder with reduced oscillation and thereby with reduced risk of the glue and primer to spill or drop.

A further object is to provide a holder that gives the maximal freedom of movements for the plumber while working.

Another object is to provide a holder, which the plumber can hang either on ladder or other supporting structure or alternatively hang it on his belt while carrying with him.

Additional advantages will become apparent from a following description and the accompanying drawings.

DETAILED DESCRIPTION OF THE INVENTION

The holder device described in FIGS. 1 to 6 is designed for carrying or hanging together the primer and glue containers used by plumbers for installing and repairing pipes.

Figure 1:
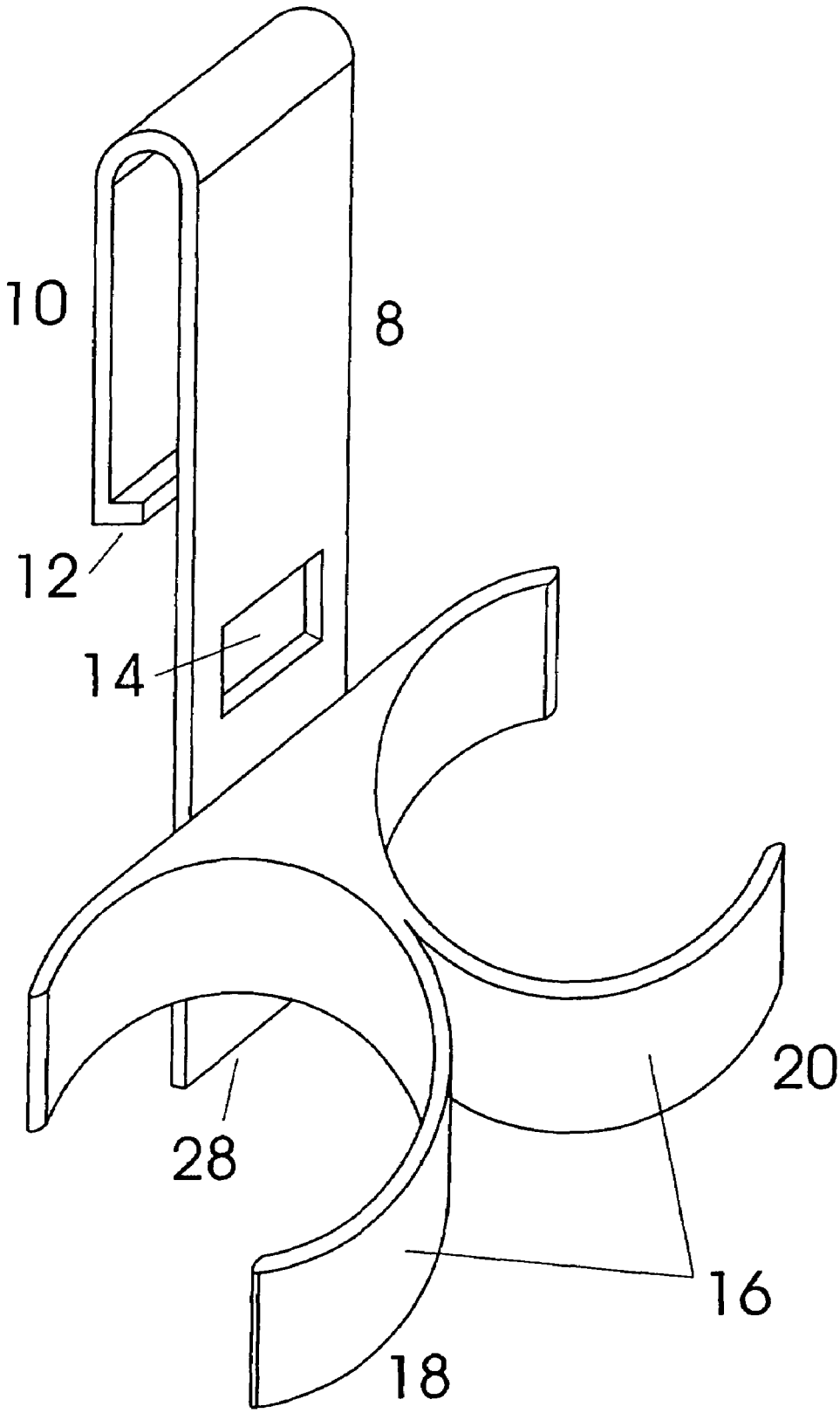
FIG. 1 is a perspective view of a preferred embodiment

FIG. 1 is a perspective view of preferred holder device. The frame is a unit member,. The thickness of which is approximately ¼ inches. The frame includes a vertical arm and two clasps. The unit structure is clasping at least tow cans by pressure, applying enough force over the containers in order to hold them properly. The cans are primer and glue containers commercially available in standard dimensions.

Figure 2:
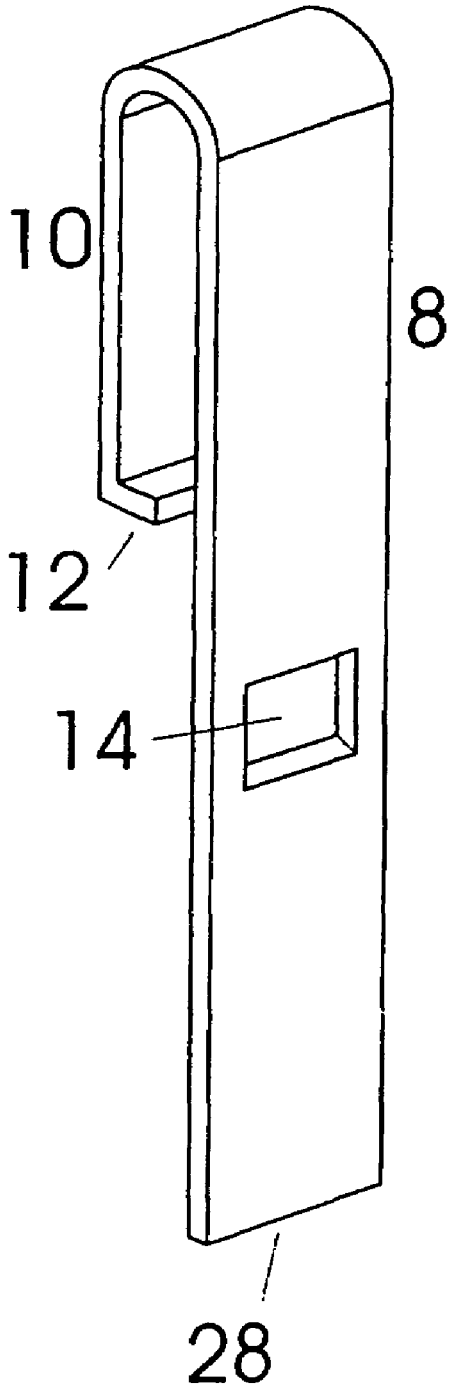
FIG. 2. Is a perspective view of a vertical arm with an upper end tongue ending in a little hook, and the elongated lower portion.

FIG. 2. Shows a vertical arm 8, which is a central support of approximately 8½ inches in length and 1½ inches wide.

FIG. 1 and FIG. 2 show the vertical arm 8 having a down folded tongue 10. The distance between the downward folded tongue 10 and the arm 8 is predetermined and it is meant for attaching the device on a belt by sliding the belt through the opening between the arm 8 and the tongue 10. The tongue 10 has a hook 12 for adjusting the device to the plumber's belt with predetermined dimensions. The commercial belt has standard dimensions.

FIG. 1 and FIG. 2 shows a free elongated portion 28 at the lower end of the vertical arm 8. During bending or other movements, the elongated portion 28 will maintain a vertical position of the containers, bringing support and balance for the entire frame and avoiding oscillations and spills from the cans.

Ther vertical arm 8 has a through hole 14, preferably of rectangular shape of approximately ⅜×⅝ inches. This through hole 14 acts as a hook, allowing the plumber to hang the device on a ladder or other supporting surface.

FIG. 1 shows an integrally molded unit with a horizontal member 16. In this embodiment the member 16 is projected perpendicularly forward form the vertical arm 8.

Figure 3:
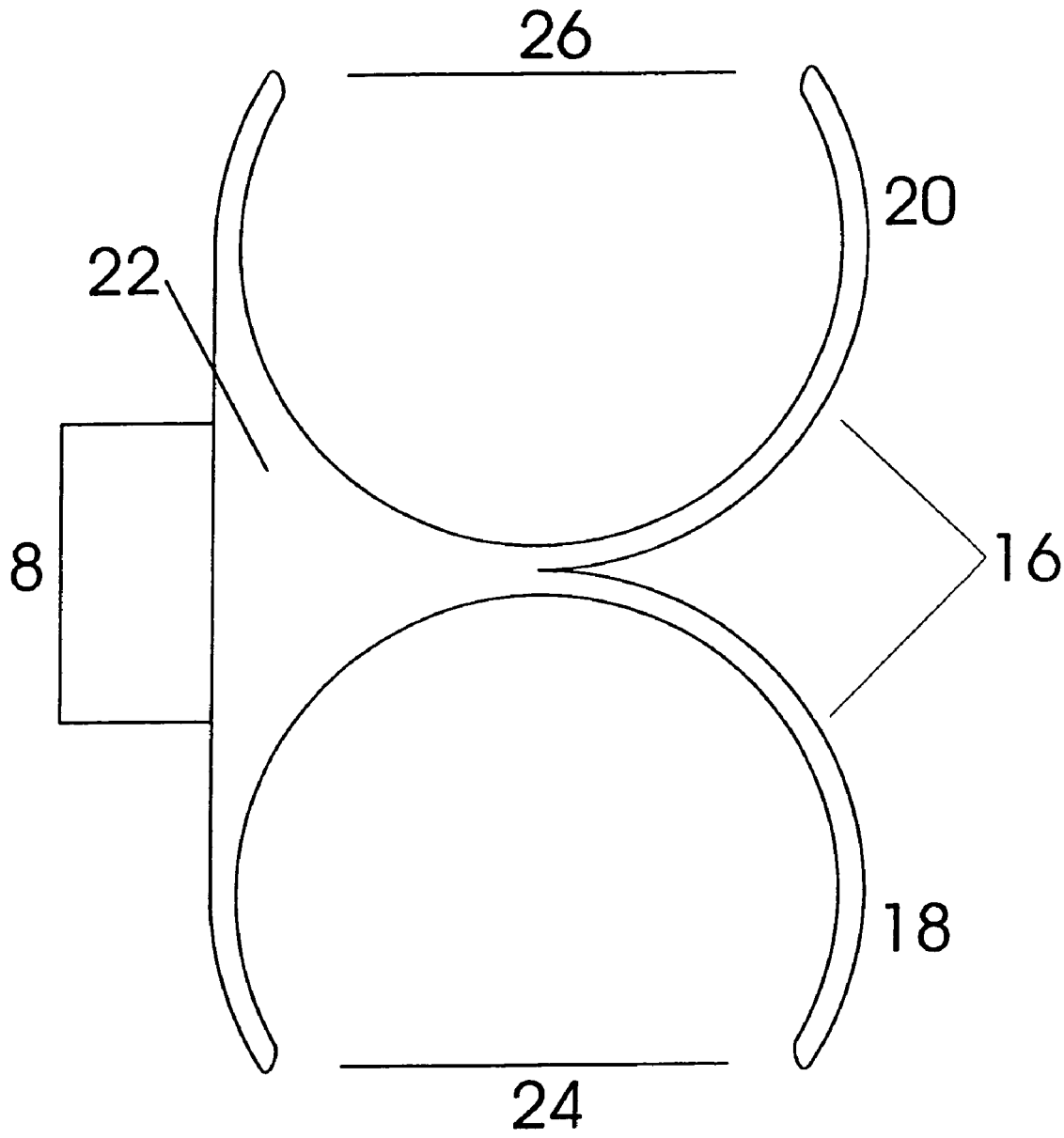
FIG. 3 is a top view of two clasps connected to the arm.

FIG. 3 shows the horizontal member 16 with tow clasps 18 and 20, which are joined together by a shaped surface portion 22, so as to form a whole unit with the vertical arm 8. Each of the clasps 18 and 20 are being adjacent to each other and approximately 1980 degree apart.

Clasps 18 and 20 have a diameter approximately of 23 inches. The width of the clasps 18 and 20 is about 1 inch.

FIG. 3 shows the clasp 18 having a lateral aperture 24 and the clasp 20 having a lateral aperture 26. The width of each aperture 24 and 26 are approximately 2½ inches. Clasps 18 and 20 are designed for gripping and clasping the primer and glue containers. Apertures 24 and 26 are shaped so that it is easy to insert the primer and glue containers.

These containers are commercially available in standard dimensions an well known by the plumbers.

Figure 4:
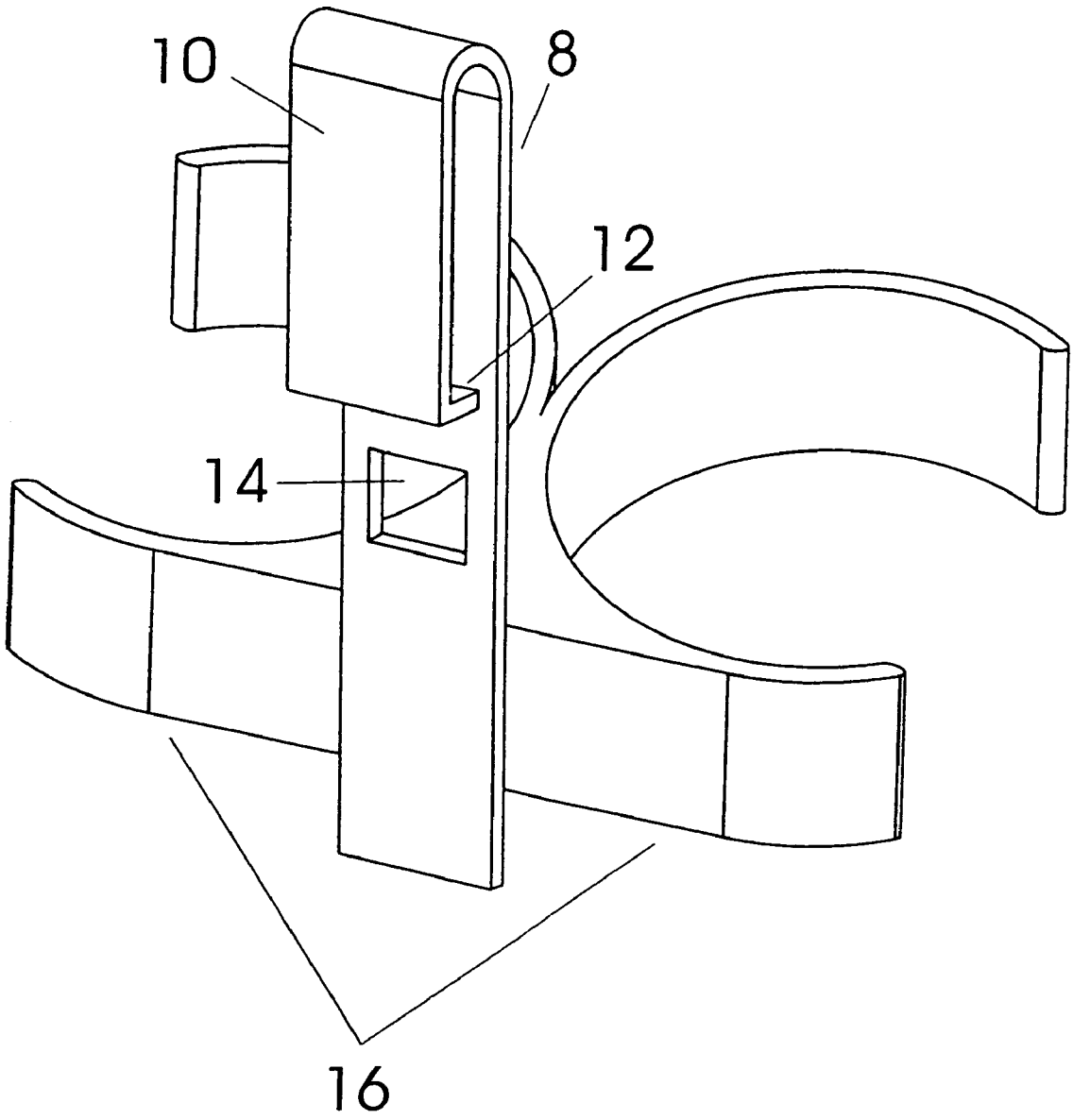
FIG. 4 is a rear view of the holder device.

FIG. 4 shows a rear perspective where the horizontal member 16 is displayed back to the tongue 10.

Although, the preferred embodiment is an integral entity, it can be made from two separate pieces. Furthermore, other predetermined shapes can join the vertical arm 8 and horizontal member 16.

In an other embodiment the clasps 18 and 20 are similarly connected by the shaped surface 22 to the vertical arm 8, but having a diameter of approximately 2½ inches and width of ⅛ inches and apertures 24 and 26 of approximately 2 to 4 inches. The vertical arm 8 is the similar to that described in the preferred embodiment.

Figure 5:
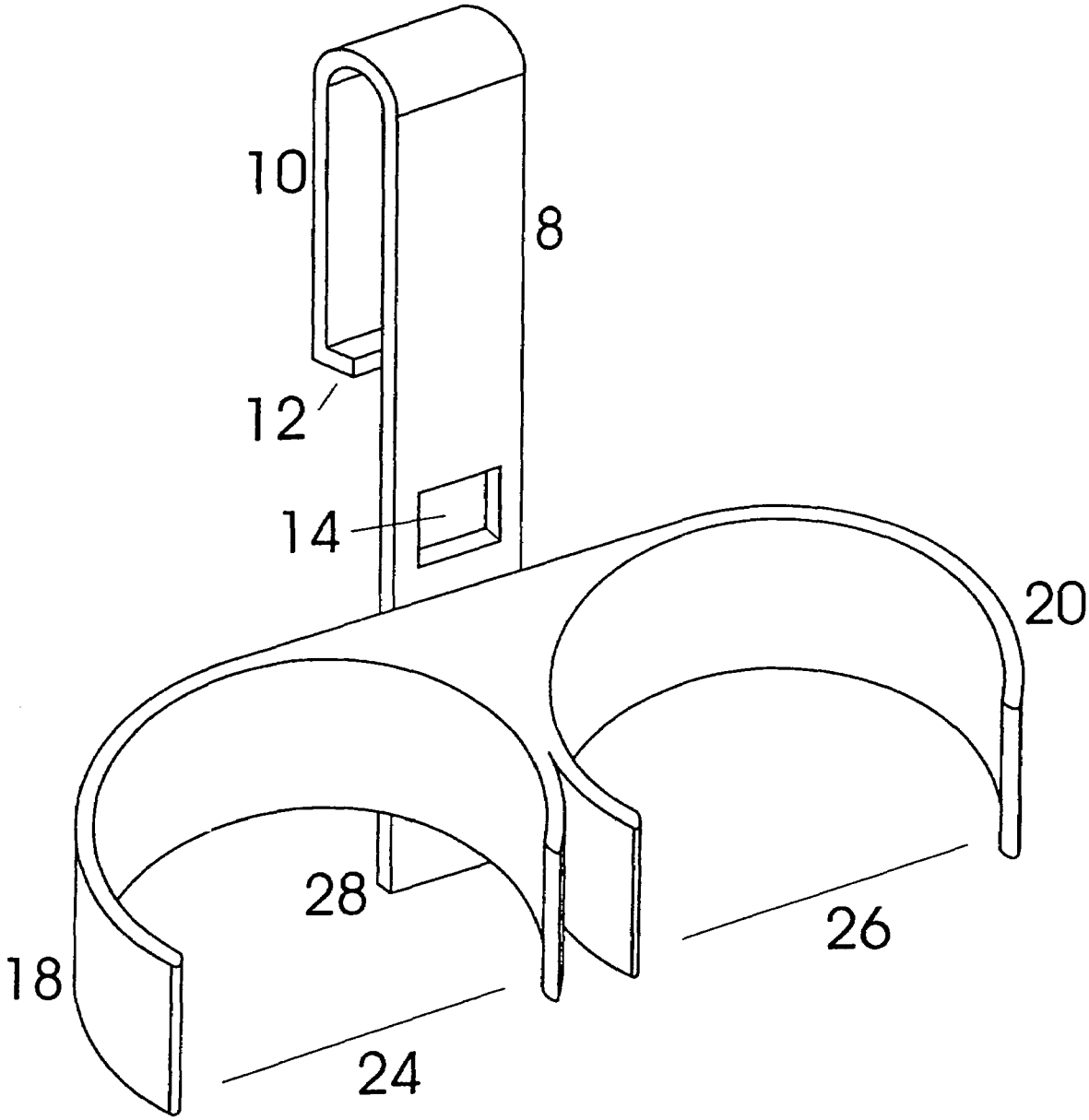
FIG. 5 is a front view showing another embodiment.

FIG. 1 and FIG. 5 show two different embodiments off the clasps.

FIG. 5 shows an alternative embodiment with frontal apertures 24 and 26. The dimensions are the same described above in the two alternative embodiments.

Figure 6:
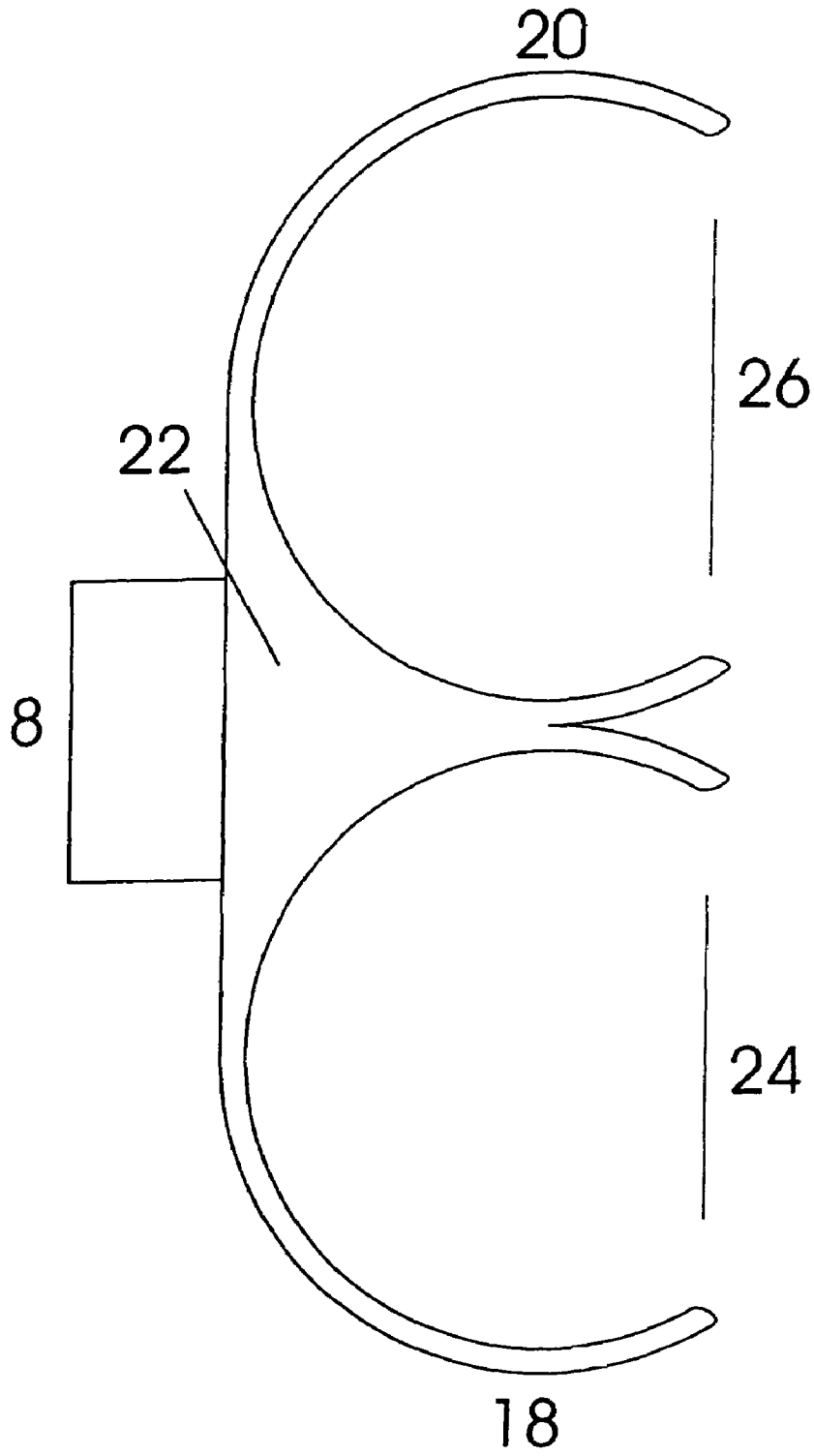
FIG. 6 is a top view of to clasps connected to the arm in one embodiment.

FIG. 6 shows a top view of the alternative embodiment shown in FIG. 5.

The holder device may be made from plastic or steel but it needs to be flexible, light and durable. Various colors can be used in commercial presentations, at least yellow caterpillar, green, orange, black and camouflage.

During the process of installing and repairing pipes the plumber can carry the holder device according to this disclosure on the belt along with other tools. The two clasps 18 and 20 embrace the containers of primer and glue by pressure and hold them together. The apertures 24 and 26 have the necessary width for introducing both the containers and consequently to clasp them. The vertical arm 8 supports the entire frame, providing stability by having the elongated portion 28. On the other hand the lengthening of the vertical arm below the clasp is important in order to degree the torque acting on the most external parts of the clasps. Such a torque would produce fatigue in the material after extensive use. The upper end tongue 10 allows hanging of the device on a belt and the through hole 14 allows hanging of the devise from a ladder or other supporting structure. The integral frame, made of flexible material is easy to carry and less expensive to manufacture.

What is claimed is:

1. A holder device for clasping standard glue and primer containers to be handled by plumbers, said devise comprising:

a vertical arm being made of one piece, said arm having an upper and a lower end;

a shaped tongue extending from the upper end of the arm and being downwardly folded and providing a predetermined standard distance between the tongue and the arm and further having a horizontal extension forming a hook enabling the plumber to adjust the device on a standard plumber's belt;

said vertical arm further having an elongated portion with predetermined dimension at the lower end, thereby providing more stability for the device; and a horizontal member being connected to the lower part of the arm and further having a shaped surface portion molded of flexible material and two cylindrical clasps, said surface portion and clasps projecting perpendicularly forward from the arm, said clasps further being adjacent to each other and approximately 180 degrees apart from each other, said clasps having an aperture of predetermined standard dimension for snugly fitting the standard containers and holding them tightly by the clasps with pressure.

2. The holder device of claim 1, wherein the vertical arm comprises a through rectangular hole of predetermined dimensions allowing hanging of the device on supporting surface.

* * * * *